United States Patent [19]

Oda et al.

[11] Patent Number: 5,027,159

[45] Date of Patent: Jun. 25, 1991

[54] ELECTROPHOTOGRAPHIC IMAGE FORMING APPARATUS CAPABLE OF DEVELOPING NORMAL AND INVERTED IMAGES

[75] Inventors: Masataka Oda; Yoshinobu Hara; Kazuyoshi Hara, all of Azuchi, Japan

[73] Assignee: Minolta Camera Kabushiki Kaisha, Osaka, Japan

[21] Appl. No.: 311,081

[22] Filed: Feb. 14, 1989

[30] Foreign Application Priority Data

Feb. 17, 1988 [JP] Japan ..... 63-35882

[51] Int. Cl.[5] ..... G03G 15/00

[52] U.S. Cl. ..... 355/271; 355/24

[58] Field of Search ..... 355/23, 24, 271, 272, 355/274

[56] References Cited

U.S. PATENT DOCUMENTS 3,697,170 10/1972 Bhagat et al. .
3,697,171 10/1972 Sullivan .
3,893,761 7/1975 Buchan et al. ..... 355/272
3,923,392 12/1975 Buchan et al. ..... 355/271
4,708,460 11/1987 Langdon ..... 355/271
4,796,048 1/1989 Bean ..... 355/277

*Primary Examiner*—R. L. Moses
*Attorney, Agent, or Firm*—Price, Gess & Ubell

[57] ABSTRACT

A transfer belt for use in an electrophotographic image forming apparatus is so arranged as to pass through a gap between a photoconductor and a transfer charger provided opposite to the photoconductor, and a second transfer charger is arranged outside the transfer belt at the downstream of a first transfer charger in the transporting direction of the transfer belt.

The first transfer charger transfers an image on the photoconductor onto the transfer belt or onto the surface of a transfer material being properly transported thereto, while the second transfer charger transfers a transferred image on the transfer belt onto the back of the transfer material being transported on the transfer belt thus enabling to form an image only on one side or on both sides of the transfer material.

18 Claims, 3 Drawing Sheets

ELECTROPHOTOGRAPHIC IMAGE FORMING APPARATUS CAPABLE OF DEVELOPING NORMAL AND INVERTED IMAGES

BACKGROUND OF THE INVENTION

1. Technical Field of the Invention

The present invention relates to an electrophotographic image forming apparatus for use in copying machines, laser beam printers and the like, and more particularly to an electrophotographic image forming apparatus capable of obtaining images on both sides of a a transfer material at one cycle of paper feeding process by transferring visualized images on a photoconductor and a transfer belt onto both sides of the transfer material.

2. Brief Description of Related Art

In a conventional copying machine, it has generally been possible to obtain images on both sides of a transfer sheet by firstly transferring and fixing a first image formed on a photoconductor onto one side of the transfer sheet, and then secondly transferring and fixing a second image on a photoconductor onto the other side of the transfer sheet by turning over the sheet.

Meanwhile, U.S. Pat. Nos. 3,697,170 and 3,697,171 disclose an image forming apparatus arranged to transfer images onto both sides of a transfer sheet by using a photoconductor and transfer roller or transfer belt, wherein the function of the transfer roller is basically the same as that of the transfer belt.

For instance, when a transfer belt is used, a first image formed on a photoconductor 31 is firstly transferred onto a transfer belt 32 by a transfer charger 33 as illustrated in FIG. 1. Then, the polarity of toner of the first image transferred onto the transfer belt 32 is reversed by a toner polarity reversing charger 34. Thereafter, a second image which was developed by toner is formed on the photoconductor 31 simultaneously with the first image whose toner polarity has been reversed is returned to the transfer section.

Coordinating with this operation, a transfer sheet 35 is supplied between the photoconductor 31 and the transfer charger 32, and a first image is transferred onto a front side of the sheet and a second image onto a back side simultaneously by the transfer charger 33 to proceed to the next fixing process. The reference numeral 36 in the figure represents a charger provided for tacking the transfer sheet 35 onto the transfer belt 32.

However, in the conventional method of performing transfer and fixing process two times each, it was required to arrange another paper feeding path for reversely transporting the transfer sheet once transferred and fixed thus causing the apparatus to become large in volume by, for instance, 30–40% to result in a considerable rise in manufacturing cost. Another problem is that heat curling can be occurred on a transfer sheet at the time of a first fixing process which causes poor paper feeding at the time of the second transfer and fixing process. Further, considerable time is required for forming images on both, sides since two cycles of paper feeding have to be performed.

In the apparatus disclosed above, the problems aforementioned can be eliminated since it is arranged to simultaneously transfer images on both sides of a transfer sheet. However, the transfer of the first image from the transfer belt to the transfer sheet and the transfer of the second image from the photoconductor to the transfer sheet are simultaneously made by the same transfer charger at the same time under the state that the transfer sheet is placed between the photoconductor and the transfer belt, and therefore, the apparatus is easily affected by the quality and thickness of the transfer sheet at the time of the transfer process thereby causing a spattering of toner and poor transfer. Moreover, when an image formation is required to be made only on one side of a transfer sheet, a proper image can hardly be formed since the transferring efficiency is different from the case when both sides are collectively transferred.

SUMMARY OF THE INVENTION

The main object of the present invention is to provide an electrophotographic image forming apparatus capable of obtaining proper images either on one side or on both sides of a transfer material by improving a transfer method of transferring a first image on a transfer belt and a second image on a photoconductor onto both sides of a transfer material in one cycle of a paper feeding process so that poor paper feeding caused by heat curling and affection by the quality and thickness of a transfer material can be avoided while enabling a much faster image formation on both sides of the transfer material.

Another object of the present invention is to provide an electrophotographic image forming apparatus capable of advantageously performing an image forming operation on both sides of a transfer material by arranging a combination of a mechanical structure of a transfer belt, transfer means and disposition of a photoconductor.

Still another object of the present invention is to provide an electrophotographic image forming apparatus capable of forming high quality images on one side or on both sides of a transfer material by giving special consideration to the quality of a transfer belt.

The other objects and features of the present invention will become more apparent from the following description taken in conjunction with the preferred embodiments thereof with reference to the accompanying drawings.

BRIEF DESCRIPTION OF THE DRAWINGS

It is to be noted that like members are designated by like reference numerals and repeated descriptions are omitted.

DESCRIPTION OF THE PREFERRED EMBODIMENT

Embodiments of the present invention will now be described below referring to the accompanying drawings.

FIGS. 2 through 5 illustrate a first embodiment of the present invention which is applied to a copying machine.

Figure 1:
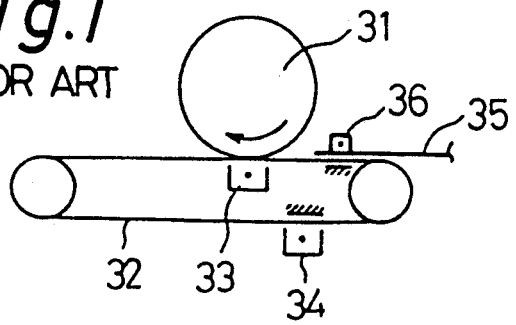
Fig.1 PRIOR ART
FIG. 1 is a side view showing a schematic structure of a conventional apparatus.
Figure 2:
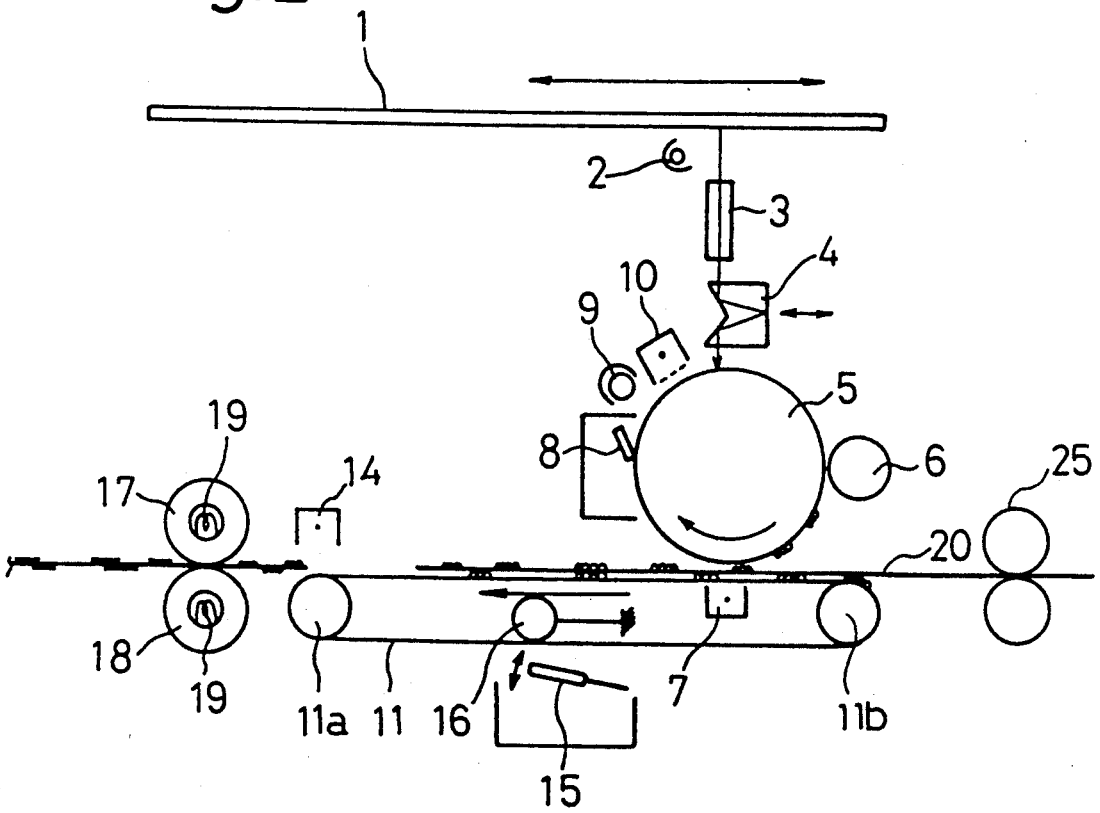
FIG. 2 is a side view illustrating a schematic structure of a first embodiment of the present invention which is applied to a copying machine.

In FIG. 2, the numeral 1 designates an original glass table on which an original is placed, and the table is movable in the direction of right and left in the figure. An original placed on the original glass table is illuminated from underneath by a light source 2, and an image of the original is slit projected onto a photoconductor 5 by an optical system 3 such as fiber lens array disposed under the original glass table 1.

The projection is made by scanning the whole image of an original with movement of the original glass table. A prism 4 is provided on a light path wherein the projection is performed. The prism 4 is moved between the position where it enters into the projecting light path and the position where it gets out of the projecting light path, by which the projected image is changed into either a normal image or a reflected image.

Around the photoconductor 5, a developing unit 6, a first transfer, charger 7, a photoconductor cleaner 8, an eraser 9 and a charger 10 are sequentially disposed in the direction of rotation of the photoconductor 5. The surface of the photoconductor 5 is uniformly charged by the charger 10 and forms an electrostatic latent image corresponding to an original image thereon.

The electrostatic latent image is developed by the developing unit 6 to form a toner image. The toner image is then transferred by the first transfer charger 7 onto either one of a transfer belt 11 or transfer sheet 20 that are in contact with the photoconductor 5.

The surface of the photoconductor 5 after transfer is cleaned by the photoconductor cleaner 8 and then the residual charge is removed by the eraser 9. The photoconductor 5 is again charged by the charger 10 to get ready for the next exposure.

Figure 3:
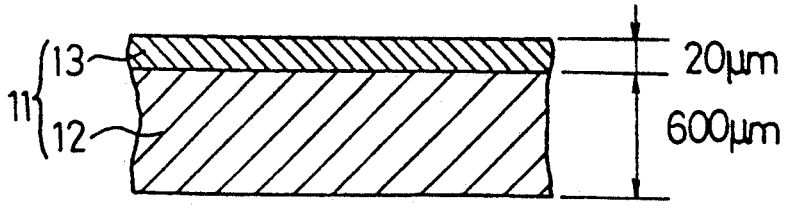
FIG. 3 is a partially expanded sectional view of a transfer belt being used in a copying machine.

The transfer belt 11 is endless and is stretched by a driving roller 11*a* and a sub-roller 11*b* so that the upper surface of the belt is under tension along the horizontal paper feed path which passes through the position between the photoconductor 5 and the first transfer charger 7. The transfer belt 11 is composed, for example, of 600 μm thick urethane rubber basic material (electric resistance $10^9$–$10^{11}$ Ωm)12 and a polytetrafluoroethylene layer (electric resistance $10^{10}$–$10^{12}$ Ωcm)13 which is formed on the surface of the urethane rubber basic material as illustrated in FIG. 3. The qualities of both of the materials have an equivalent electic resistance characteristics to that of the transfer sheet and constitute a semiconductor type transfer belt.

The transfer belt 11 is positioned between the photoconductor 5 and the first transfer charger 7 at the location near the sub-roller 11*b* and a second transfer charger 14 is disposed above the driving roller 11*a*.

Under the transfer belt 11, a belt cleaner 15 is provided and a backup roller 16 is disposed across the transfer belt. At the discharge side of the transfer belt 11, an upper fixing roller 17 and a lower fixing roller 18 are disposed facing each other across the paper feed path, and a register roller 25 is disposed opposite to the fixing rollers for transporting a transfer sheet 20 at a predetermined timing. The numeral 19 designates their heater lamps.

The movement for performing both sides copying will first be described with reference to FIG. 2.

Under the state that the prism 4 is put on the light path as shown in FIG. 2, a first original is placed on the original glass table 1 and the table is moved from a right to left side in the figure to form an electrostatic latent image of a normal image onto the photoconductor 5 charged at −500 V. The latent image on the photoconductor 5 is developed by toner with the developing unit 6 which is provided with a developing bias of −150 V. The first toner image is transferred onto a transfer belt 11 by the first transfer charger 7 and makes one cycle of rotation without having been cleaned by the belt cleaner 15. The belt cleaner 15 is only made in contact with the belt again for cleaning after the first image has passed through.

Then, under the state that the prism 4 is placed out of the light path, a second original is placed on the original glass table 1 and the table is moved from left to right in the figure to form an electrostatic latent image of a reflected image onto the charged photoconductor 5. The latent image on the photoconductor 5 is developed by toner with the developing unit 6 to form a second toner image.

In this case, the first toner image which has made one cycle of rotation on the transfer belt 11 and an edge of the second toner image on the photoconductor 5 are arranged to simultaneously coincide with each other at the position where the photoconductor 5 contacts the transfer belt 11. The transfer sheet 20 is fed by the register roller 25 with a timing that the front edge of the toner image coincides with the front edge of the transfer sheet 20.

The second toner image on the photoconductor 5 is then transferred onto the upper surface of the transfer sheet 20 by the first transfer charger 7, and the first toner image on the transfer belt 11 is transfered onto the undersurface of the transfer sheet 20 by the second transfer charger 14 disposed opposite to the driving roller 11*a*.

The first and second transfer chargers 7,14 are both impressed with a of −5.5 KV in the same polarity. The second transfer charger 14 is disposed opposite to the driving roller 11*a*, and is backed up by the driving roller 11*a* to prevent waving and wrinkles of the transfer belt 11. Thus, the separation of the transfer sheet 20 from the transfer belt is avoided and an excellent transfer can be performed without having the transferred toner image blurred since there occurs no waving and wrinkles on the transfer belt 11. The same effect can be secured even if the second transfer charger 14 is disposed adjacent the driving roller 11*a*.

The toner image is thus transferred onto both sides of a transfer sheet, and the transfer sheet 20 discharged from the transfer belt 11 is transported to the location between the upper and lower fixing rollers 17,18 which are thermally controlled at approximately 185° C. for simultaneous both sides fixing.

Figure 4:
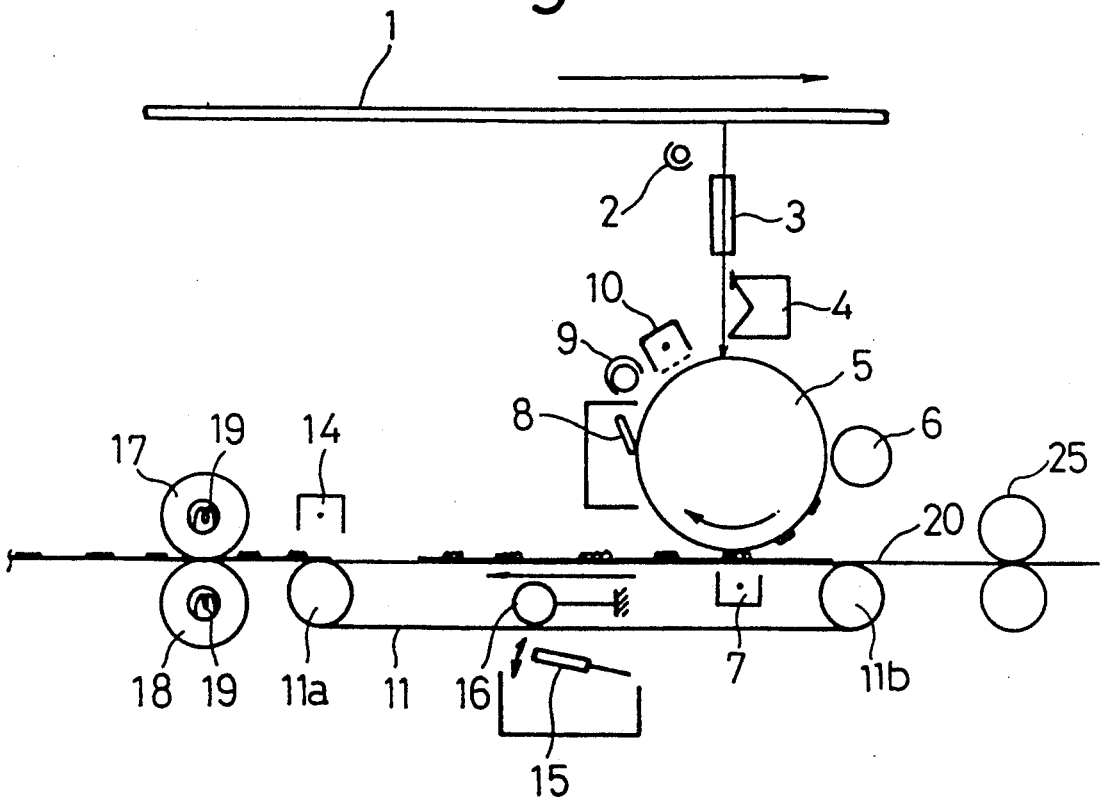
FIG. 4 is a side view showing a state of operation under which one side copying is performed.

The movement for performing one side copying will now be described with reference to FIG. 4.

Under the state that the prism 4 is placed out of the light path as shown in the figure, an original is placed on the original glass table 1, and the original glass table 1 is moved from the left to the right side in the figure to form an electrostatic latent image of a reflected image on the photoconductor 5. The latent image on the photoconductor 5 is developed by toner with the developing unit 6 to form a toner image.

The transfer sheet 20 is then fed by the register roller 25 so as to have the front edge of a toner image coincide with the front edge of the transfer sheet at the position between the transfer belt 11 and the photoconductor 5 on the paper feed path, and a toner image is transferred onto the transfer sheet 20 by the first transfer charger 7. The transfer sheet is then transported toward the fixing rollers 17,18 by the transfer belt 11 to complete one side copying after fixing the toner image.

Figure 5:
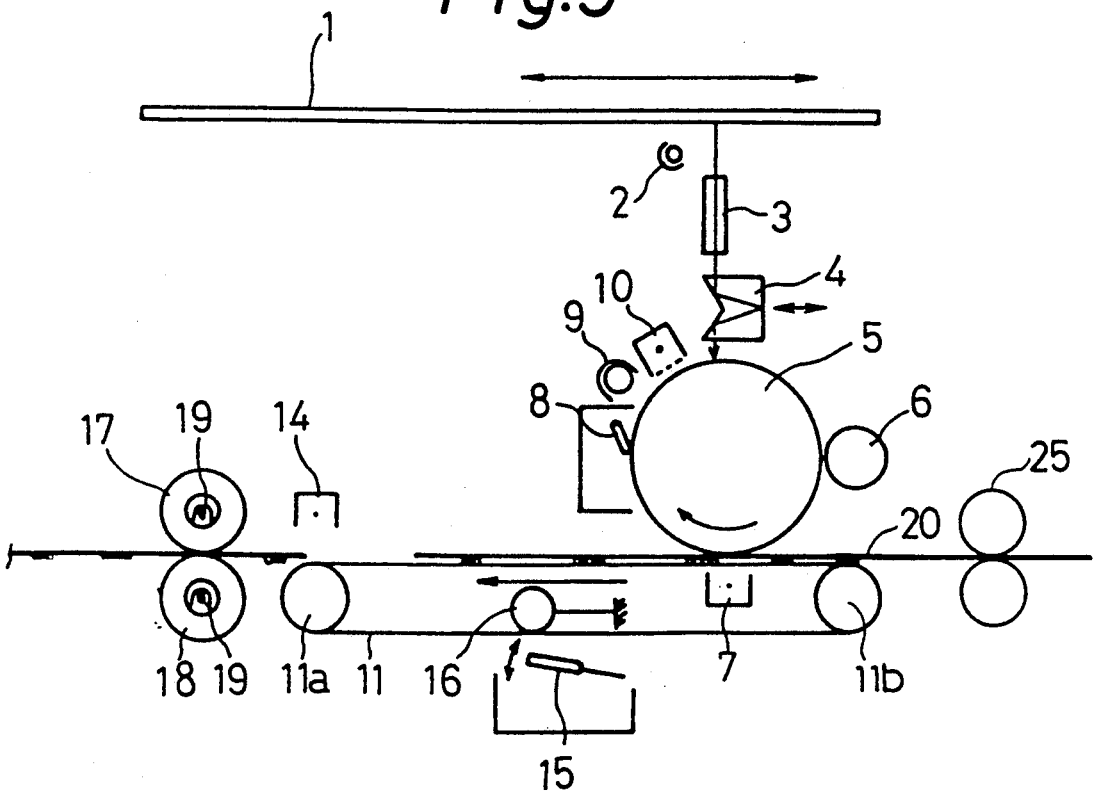
FIG. 5 is a side view showing a state of operation under which composite copying is performed.

The movement for performing composite copying will now be described with reference to FIG. 5.

Under the state that the prism 4 is placed in the light path as shown in the figure, a first original is placed on the original glass table 1, and the original glass table is moved from the right to the left side in the figure to form an electrostatic latent image of a normal image onto the photoconductor 5. The latent image on the photoconductor is developed by toner with the developing unit 6. This first toner image is transferred onto the transfer belt 11 by the first transfer charger 7 and travels one cycle of rotation without having been cleaned by the belt cleaner 15. The belt cleaner 15 is kept released from a state of pressed contact with the transfer belt even after the first toner image has passed through.

Then, a second original is placed on the original glass table 1 and a second toner image is formed in the same manner as the first toner image which is thereafter transferred onto the transfer belt 11 by the first transfer charger 7. In this case, the first toner image which has traveled one cycle of rotation on the transfer belt 11 and the second toner image on the photoconductor 5 are arranged to simultaneously coincide with each other at the position where the photoconductor 5 comes into contact with the transfer belt 11.

The transfer belt 11 is further rotated and the transfer sheet 20 is fed by the register roller 25 so as to have the front edge of the transfer sheet 20 coincide with the front edge of the toner image. The belt cleaner 15 is pressed again to come in contact with the belt after the first and second images have passed through. Thereafter, the first and second toner images on the transfer belt 11 are composed by the second transfer charger 14 and are transferred onto the undersurface of the transfer sheet 20. Thus, the transfer sheet 20 with the composite toner image transferred on its undersurface is discharged from the transfer belt 11 for the fixing process by the lower fixing roller 18 to obtain a composite image. A composite image in a plurality of colors may be obtained by providing a plurality of developing units 6 and by changing the colors of the first and second toner images. The selection for each mode, of copying operation, i.e., both sides copying, one side copying or composite copying, is arranged to be made with a selection switch provided on an unillustrated control panel.

In the embodiment aforementioned, a semiconductor type transfer belt 11 which is provided with the same electric resistance characteristic as that of a transfer sheet is used, and the transfer of a toner image from the photoconductor 5 by the first transfer charger 7 and the reverse transfer of the transferred toner image by the second transfer charger 14 onto a transfer sheet 20 are satisfactorily performed to accomplish a high quality both sides copying.

Figure 6:
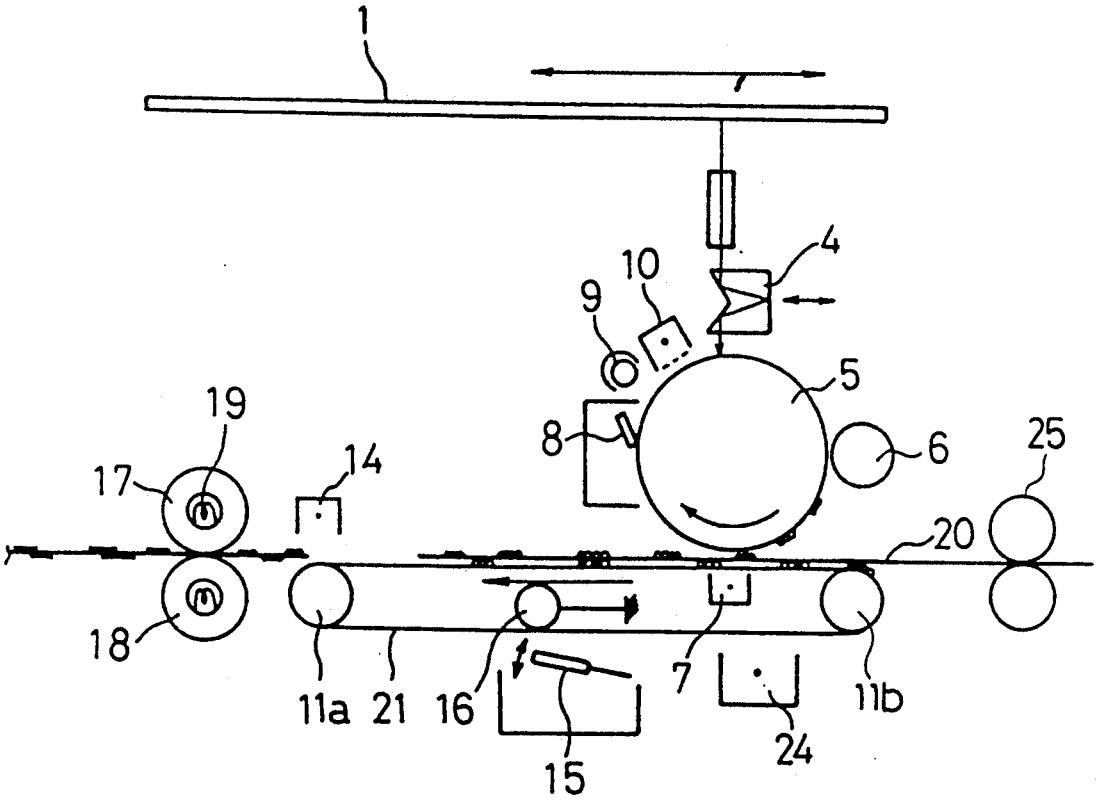
FIG. 6 is a side view showing a schematic structure of a second embodiment of the present invention which is applied to a copying machine.
Figure 7:
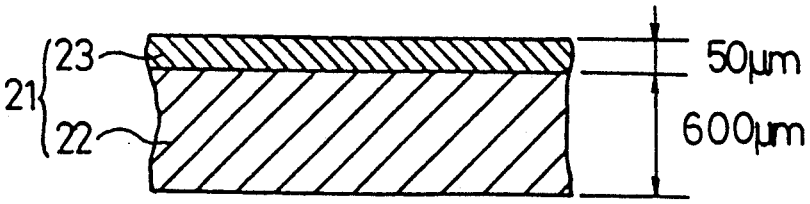
FIG. 7 is a partially expanded sectional view of a transfer belt being used in a copying machine.

With regard to the transfer belt 11, a dielectric type transfer belt 21 may also be used which is composed, for instance, of a 600 μm thick polystyrene basic material which contains carbon black as a conductive filler (electric resistance below $10^6$ Ωcm)22 and a 50 μm thick polystyrene layer as a dielectric layer (electric resitance over $10^{14}$ Ωcm)23 which is formed on the surface of the polystyrene basic material as illustrated in FIG. 7. In this case, an eraser 24 is provided as shown in FIG. 6 for eliminating static charge on the transfer belt 21 after the transfer step is over. The backup roller 16 is composed of a conductive material and is grounded. Accordingly, high quality both sides copying can be accomplished like the previous embodiment described above. In the above embodiment, an example was described when the present invention is applied to a copying machine, however, it may be applicable to a printer as well.

In the electrophotographic image forming apparatus of the present invention, fixing is made after images are transferred onto both sides of a transfer sheet as described above, and therefore, it is not necessary to turn over a transfer sheet when the sheet is fed. Moreover, images can be formed on both sides of a transfer sheet rapidly without enlarging the apparatus, and irregular paper feeding caused by heat curling can also be avoided. Further, the present invention is arranged to perform a transfer process independently by first and second transfer means for the first and second images so that the quality and thickness of a transfer sheet do not affect the function of the apparatus thereby enabling to obtain a proper image without having fears of toner spattering and poor quality of transfer. When one side image formation is performed, a proper image can be formed just like the case of both side copying by transferring an image by a first transfer means, and excellent effect is shown.

By positioning one end of a transfer belt between a photoconductor and a first transfer charger and having another end of the belt positioned opposite to a second transfer charger under the state that the transfer belt is stretched by two rollers, an ordinary copying onto one side of a transfer material and composite copying with two images being copied onto both sides of a transfer material can be satisfactorily accomplished with a compact apparatus.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electrophotographic image forming apparatus, comprising:

an image forming means for selectively forming a visualized image by developing a latent image produced by selectively projecting a normal image and an inverted image on an image bearing member;

an endless member for receiving the inverted image from the image bearing member at a transfer position opposite to the image bearing member;

a transporting means for transporting a transfer material to the endless member in order to transport the transfer material to the transfer position;

a first transfer means disposed opposite to the transfer position for transferring the inverted image on the image bearing member to the endless member before the transfer material is transported to the transfer position by the transporting means and for transferring the inverted image on the image bearing member to the transfer material when the transfer material is transported to the transfer position by the transporting means; and a second transfer means disposed downstream of the first transfer means with respect to the transporting direction of the transfer material for transferring the inverted image having been transferred on the endless member onto the transfer material.

2. An electrophotographic image forming apparatus as claimed in claim 1, wherein the endless member has equivalent electric resistance characteristics to that of the transfer material.

3. An electrophotographic image forming apparatus as claimed in claim 1, wherein the endless member is provided with a dielectric layer on the surface of a conducting layer and further includes an any means for erasing electric charge remaining on the endless member after transfer.

4. An electrophotographic image forming apparatus as claimed in claim 1, wherein the first transfer means and second transfer means are of the same polarity corona discharging devices.

5. An electrophotographic image forming apparatus as claimed in claim 1, wherein the endless member is an endless belt stretched by two rollers aligned in the transporting direction of the transfer material.

6. An electrophotographic image forming apparatus as claimed in claim 5, wherein the endless belt is positioned at a location between the image bearing member and the first transfer means.

7. An electrophotographic image forming apparatus as claimed in claim 6, wherein the second transfer means is disposed outside the endless belt and facing the roller provided downstream of the first transfer means with respect to the transporting direction of the transfer material.

8. An electrophotographic image forming apparatus, comprising:

an image forming means for selectively forming a visualized image by developing a latent image produced by selectively projecting a normal image and an inverted image on an image bearing member;

an endless member for receiving the inverted image from the image bearing member at a transfer position opposite to the image bearing member;

a transporting means for transporting a transfer material to the endless member in order to transport the transfer material to the transfer position;

a first transfer means disposed opposite to the transfer position for transferring the inverted image on the image bearing member to the endless member before the transfer material is transported to the transfer position by the transporting means and for transferring the inverted image on the image bearing member to the transfer material when the transfer material is transported to the transfer position by the transporting means;

a second transfer means disposed downstream of the first transfer means with respect to the transporting direction of the transfer material for transferring the inverted image having been transferred on the endless member onto the transfer material; and a fixing means disposed downstream of the second transfer means in the transporting direction of the transfer material for fixing the image on the transfer material onto the transfer material.

9. An electrophotographic image forming apparatus as claimed in claim 8, wherein the endless member has equivalent electric resistance characateristics to that of the transfer material.

10. An electrophotographic image forming apparatus as claimed in claim 8, wherein the endless member is provided with a dielectric layer on the surface of a conducting layer and further includes an erasing any means for erasing electric charge remaining on the endless member after transfer.

11. An electrophotographic image forming apparatus as claimed in claim 8, wherein the first transfer means and second transfer means are of the same polarity corona discharging devices.

12. An electrophotographic image forming apparatus as claimed in claim 8, wherein the endless member is an endless belt stretched by two rollers at a location between the transporting means and the fixing means.

13. An electrophotographic image forming apparatus as claimed in claim 12, wherein the second transfer means facing the endless belt is disposed between the first transfer means and the fixing unit.

14. An electrophotographic image forming apparatus, comprising:

means for positioning an original to be copied;

means for recording images from the original;

means, positioned between the original position and the recording means, for selectively inverting the images to be incident on the recording means;

means for developing the images on the recording means;

transfer means for selectively removing developed images from the recording means for transfer to a copy paper, and means for transporting copy paper to permit a transfer of developed images from the recording means directly and/or the transfer means, whereby a developed image can be directly transferred to the copy paper from the recording means on one side, and an inverted developed image that has been reinverted by the transfer means can be transferred from the transfer means to the other side of the same copy paper.

15. An electrophotographic image forming apparatus ad claimed in claim 14 wherein the means for selectively inverting the images includes a prismatic member that can be selectively inserted in an optical path between the original position and the recording means.

16. An electrophotographic image forming apparatus as claimed in claim 14 wherein the transfer means includes an endless transferring belt member.

17. An electrophotographic image forming apparatus as claimed in claim 16 wherein the means for transporting the copy paper includes the endless transferring belt member.

18. An electrophotographic image forming apparatus, comprising:

means for positioning an original to be copied;

means for recording images from the original;

toner means for developing the images on the recording means;

transfer belt means for selectively removing developed toner images from the recording means for subsequent transfer to a copy paper, and means for transporting copy paper to permit a transfer of developed toner images from the recording means directly and/or the transfer belt means, whereby a developed toner image can be directly transferred to the copy paper from the recording means on one side, and a developed toner image can be transferred from the transfer means to the other side of the same copy paper.

* * * * *